US009250560B1

(12) United States Patent
Judd et al.

(10) Patent No.: US 9,250,560 B1
(45) Date of Patent: Feb. 2, 2016

(54) LED PRINT BAR IMAGING APPARATUS AND SYSTEMS USEFUL FOR ELECTROPHOTOGRAPHIC PRINTING

(71) Applicant: XEROX CORPORATION, Norwalk, CT (US)

(72) Inventors: Derek W. Judd, Hertfordshire (GB); Brian N. Reid, Hertfordshire (GB); Michael J. Wilsher, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/477,859

(22) Filed: Sep. 5, 2014

(51) Int. Cl.
*B41J 2/45* (2006.01)
*G03G 15/04* (2006.01)

(52) U.S. Cl.
CPC ..... *G03G 15/04054* (2013.01)

(58) Field of Classification Search
USPC ..... 347/230, 238, 241, 242, 244, 245, 347/256–258, 263
See application file for complete search history.

(56) References Cited

U.S. PATENT DOCUMENTS

| | | | | |
|---|---|---|---|---|
| 5,703,860 | A * | 12/1997 | Fukunaga et al. | 369/102 |
| 6,989,849 | B2 * | 1/2006 | Nomura et al. | 347/133 |
| 7,085,095 | B2 * | 8/2006 | Saliba et al. | 360/77.12 |
| 7,267,002 | B2 * | 9/2007 | Itakura et al. | 73/335.03 |
| 2008/0068439 | A1 * | 3/2008 | Koshimura et al. | 347/238 |

FOREIGN PATENT DOCUMENTS

| | | | | |
|---|---|---|---|---|
| JP | 04246668 | A * | 9/1992 | B41J 2/44 |
| JP | 2006076126 | A * | 3/2006 | B41J 2/44 |

OTHER PUBLICATIONS

U.S. Appl. No. 14/086,829, filed Nov. 21, 2013, entitled "Dynamic Adjustable Focus for LED Writing Bars Using Piezoelectric Stacks".

* cited by examiner

*Primary Examiner* — Hai C Pham
(74) *Attorney, Agent, or Firm* — Ronald E. Prass, Jr.; Prass LLP

(57) ABSTRACT

A print head system useful for xerographic printing includes an LED bar print head; a photoreceptor, the photoreceptor having a conductive surface; a sensor, the sensor being disposed on the LED bar, the LED bar being disposed a conjugate distance from the photoreceptor, wherein the sensor and the photoreceptor are configured to enable a measurement of the conjugate distance.

16 Claims, 4 Drawing Sheets

LED PRINT BAR IMAGING APPARATUS AND SYSTEMS USEFUL FOR ELECTROPHOTOGRAPHIC PRINTING

FIELD OF DISCLOSURE

The disclosure relates to imaging apparatus and systems. In particular, the disclosure relates to light-emitting diode ("LED") bar-type print head imaging apparatus and systems useful for printing, including xerographic printing.

BACKGROUND

LED print head imaging devices have replaced traditional ROS laser systems, enhancing cost savings and addressing reliability and uniformity issues. LED bar-type print head imaging apparatus and systems may include a print bar imager assembly having an array, usually linear, of individual sources. A print bar may comprise an array formed of smaller sub-arrays arranged side-by-side.

A print "bar" as used in this document means a structure or device holding an arrangement of light emitting diode ("LED") print heads that remains stationary during printing. For print bars or print heads, the LED bar is the current state of the art. A lens mechanism such as a rod lens array, commercially available under the trademark SELFOC, can be used in the print bar for focusing the light emitted by the LED or LED array on the photosensitive recording member such as a photoreceptor (P/R) medium.

Due to limitations and tolerances of the lens mechanism, the depth of focus of a SELFOC lens is very small. Depth of focus is the tolerance in which either the light source, the SELFOC lens, or the photoreceptor can have a positional error (about ±60 μm) with respect to the other two components without losing the focus. Moving out of this focus range results in imaging defects. Maintaining this mechanical tolerance (about ±60 μm) may require adjustment due to production variations and environmental changes or wear over life. This constant adjustment adds to design and production cost. Various techniques have been proposed to address the so-called depth of focus problem in electrophotographic printing. Depth of focus correction methods have included replacing the light source with a laser, changing a spot size by eliminating the lens mechanism, and software processing to change the illumination profile of the light source.

There is a need in the art for methods and systems that can economically and optimally control the position of the print bar to correct for process variations and other factors that may adversely affect the depth of focus or positional errors when forming an image on a photoreceptor medium.

SUMMARY

Alignment accuracy was found to be a significant mechanical challenge in LED bar print head systems and methods. For example, it has been found that it is extremely difficult to determine the position of the bar with respect to the position of the photoreceptor.

Apparatus, systems, and methods are provided that include determining a position of an LED bar with respect to a photoreceptor using capacitance measurement. In particular, using a series of sensor pads, distance, parallelism and skew may be calculated. This contactless measurement method may be implemented at low cost, and may be used with alignment adjustment either manually or automatically.

Exemplary embodiments are described herein. It is envisioned, however, that any system that incorporates features of systems described herein are encompassed by the scope and spirit of the exemplary embodiments.

DETAILED DESCRIPTION

Exemplary embodiments are intended to cover all alternatives, modifications, and equivalents as may be included within the spirit and scope of the systems and methods as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of LED print head imaging apparatus, methods, and systems in accordance with embodiments.

Figure 1:
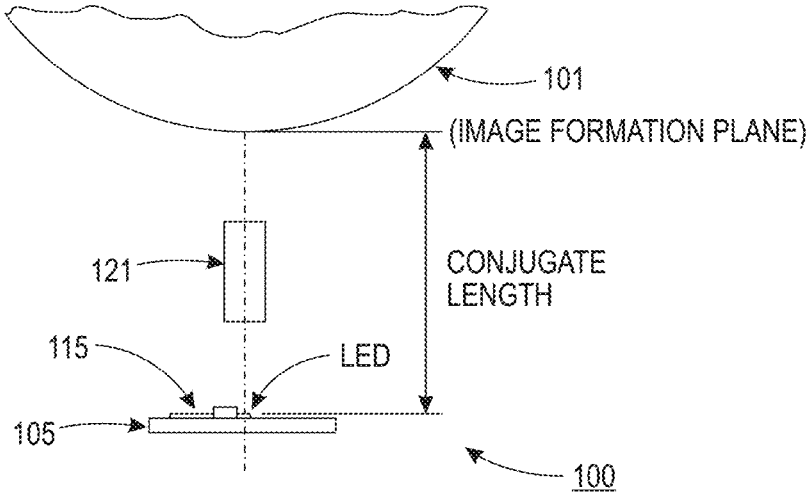
FIG. 1 shows an LED bar requirement for controlled conjugate length.

FIG. 1 shows a related art print head bar system 100 including an LED. In particular, FIG. 1 shows a print head bar system 100 including an imaging member or drum 101, an LED array unit or LED bar 105, an LED driver 115, and a rod lens array 121.

Figure 2:
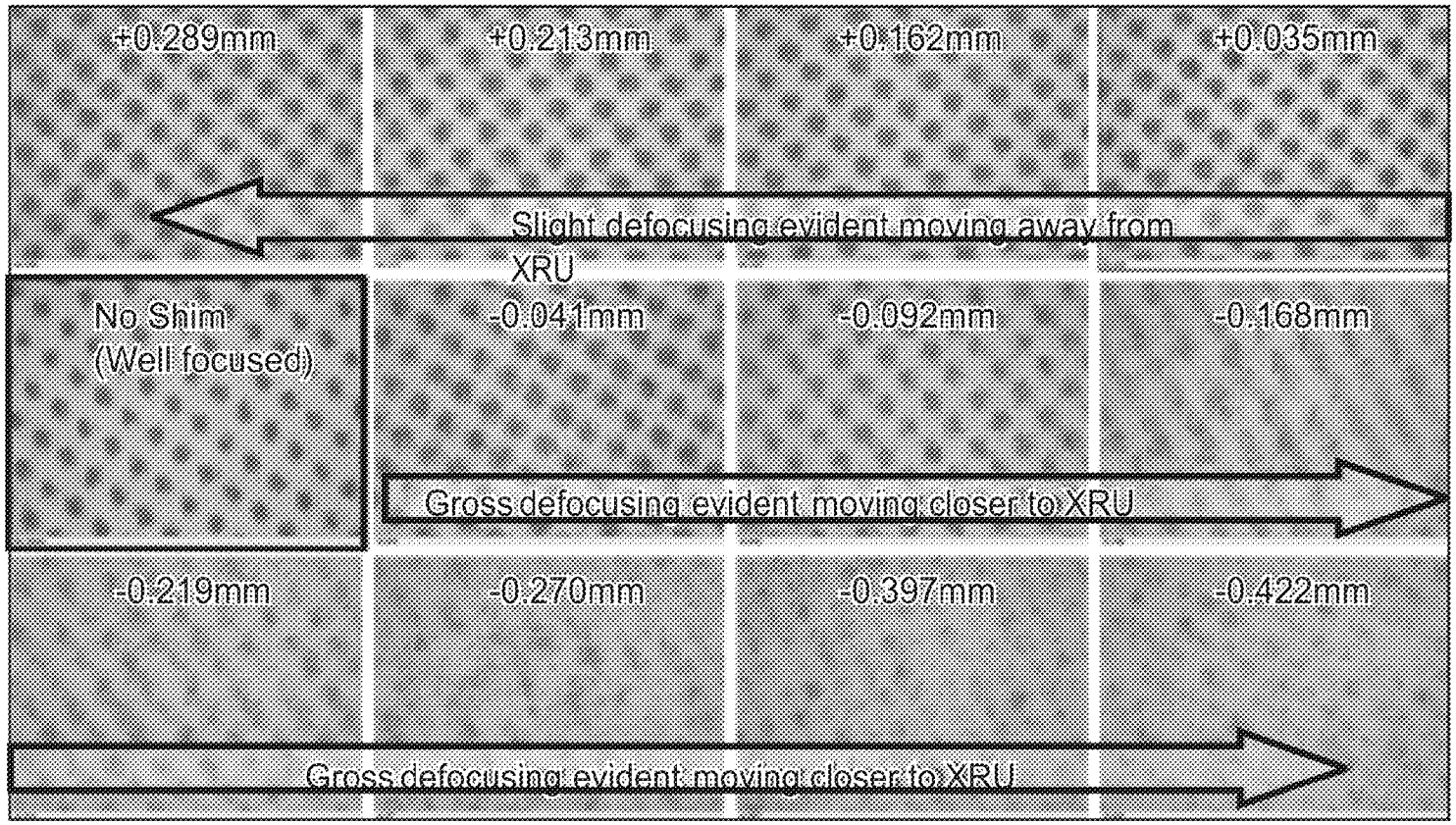
FIG. 2 includes a graph showing the measured effects of change in focus of an LED bar.
Figure 3:
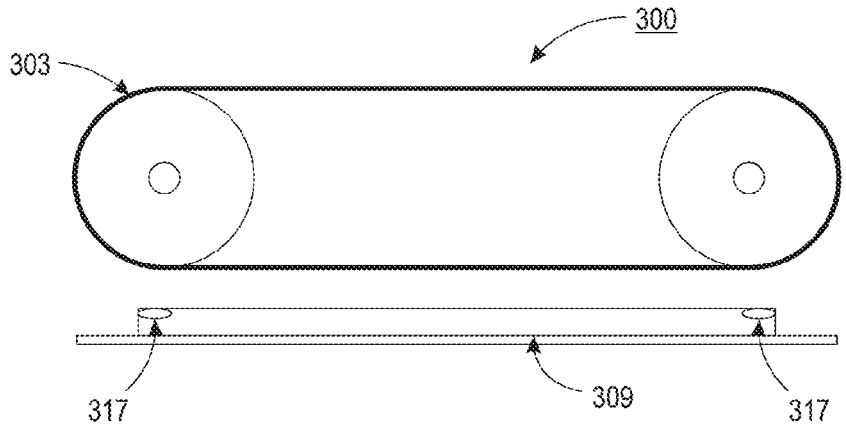
FIG. 3 shows a side diagrammatical view of an LED print head imaging system in accordance with an exemplary embodiment.

Related art systems such as those shown in FIG. 1 suffer from poor depth of focus at about 60 microns. It has been found that the poor depth of focus may be caused by use of a SELFOC lens, a self-focusing micro lens. Beyond this depth of focus, imaging defects tend to occur. Moving out of focus results in imaging defects, as shown in FIG. 2, and the related art does not provide an adequate method of measuring this distance in an assembled apparatus. FIG. 3 shows an LED print head imaging system in accordance with an exemplary embodiment. Systems and methods of embodiments enable calculation of a position using a series of capacitance pads that work together to enable calculation of a separation between plates, e.g., a photoreceptor having a conductive surface and an LED bar.

$$C = \varepsilon_r \varepsilon_0 \frac{A}{d}$$

Using the formula shown immediately above, plate separation may be determined. C is capacitance; A is the area of overlap between two plates, ∈r is the relative static permittivity (sometimes called the dielectric constant) of the material between the plates (for a vacuum, ∈r=1 for Air 1.00058986±0.00000050 (at STP, for 0.9 MHz)); ∈0 is the electric constant (∈0≈8.854×10−12 F m−1); and d is the separation between the plates.

Typically, for a 10 mm circular plate and a 0.5 mm gap C=1.00058986×8.854×10−12×3.14159×10−4/0.05=5.5664 pf, control should be better than 50 um. At a 0.055 mm distance, that is a change of 6.1230 pf−5.5665 pf, or a measurement accuracy of better than 0.5 pf. For a given system, substantially A, ∈r and ∈0 are fixed once calibrated (or can be corrected with temperature/humidity measurements) so C is inversely proportional to d, the distance between the two surfaces. The system will normally also contain temperature and humidity sensors to monitor internal conditions. These may be used to correct changes in the capacitance sensor due to changes in temperature and humidity, and improve the accuracy.

Systems in accordance with embodiments may be configured to define a fixed distance as a conjugate length between an LED bar, which has a conductive sensor pad forming one plate of the capacitor and a photoreceptor, which forms the other plate of the capacitor. The fixed distance may be entered as the calibration point at manufacture. A capacitance reading is understood to be inversely proportional to the distance, and accordingly, distance adjustments may be made to return to the calibration point or desired capacitance reading. The calibration point eliminates most inaccuracies inherent in the system and provides a datum to work from. The calibration point may be determined at manufacture where a known spacer, for example, may be used to set the LED to Photoreceptor distance and a datum capacitance reading taken.

As shown in FIG. 3, an LED print head apparatus and system 300 in accordance with an exemplary embodiment may include an imaging member or photoreceptor 303, and an LED bar 309 positioned operably proximate to the photoreceptor 303. The LED bar may be configured to include an LED or LED array. Further, the LED bar may be configured to include one or more sensor pads.

FIG. 3 shows an LED bar 309 including first and second sensor pads 317. Sensor pads 317 may be configured to function as capacitance pads that work with temperature and humidity sensors to calculate a separation between the LED bar 309 and the imaging member 303, which has a conductive surface. In this manner, a conjugate length or distance between an image formation plane at the photoreceptor 303 and the LED bar 309 may be determined and adjusted to, for example, maintain a pre-determined desired conjugate length.

Figure 4:
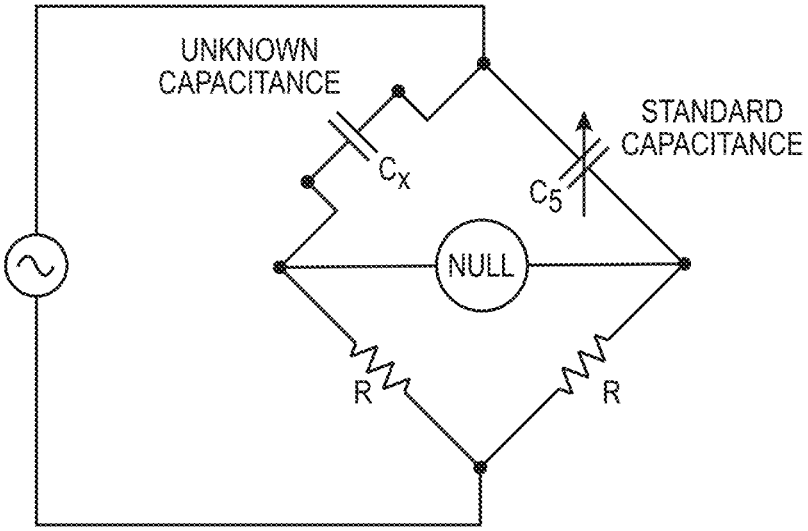
FIG. 4 shows a capacitance bridge.

Single sensor pads 317 are each disposed at an end of an optical center of bar LED 309 in the system 300. The optical center is on an apex of the imaging member 303 along a center line. Using this configuration, a capacitance probe may be configured to read a value inversely proportional to distance. Typically, the capacitance is measured by a capacitance bridge with the active components mounted very close to the measurement plate to minimize stray capacitance. FIG. 4 shows a known capacitance bridge.

LED print head imaging apparatus and systems disclosed herein to measure the LED-to-photoreceptor distance may be combined with LED print head features disclosed by Judd et al. in U.S. patent application Ser. No. 14/086,829, filed Nov. 21, 2013, titled "Dynamic Adjustable Focus For LED Writing Bars Using Piezoelectric Stacks," the entire disclosure of which is incorporated herein by reference in its entirety. For example, Judd discloses methods of dynamic focusing of an LED print bar or print head using piezoelectric stacks. The stack may be mounted on either end of the LED bar to adjust the focus along the length of the bar against the photoreceptor surface. The piezo level may be controlled through active feedback, such as optical or electrical, or as a service or manufacturing input. With electronic control, focus adjustments may be made by the machine, and dynamically, if needed. Judd also discloses a system wherein a flextensional cell structure is employed to amplify the movement of the piezo stack to move the LED bar in the order of greater than 50 microns closer or away from the photoreceptor surface. A distance may be maintained using an LED print bar imaging apparatus and system in accordance with embodiments provided herein for maintaining a desired distance between a photoreceptor and LED bar during camming operations wherein the bar is moved off of and onto the photoreceptor.

Figure 5:
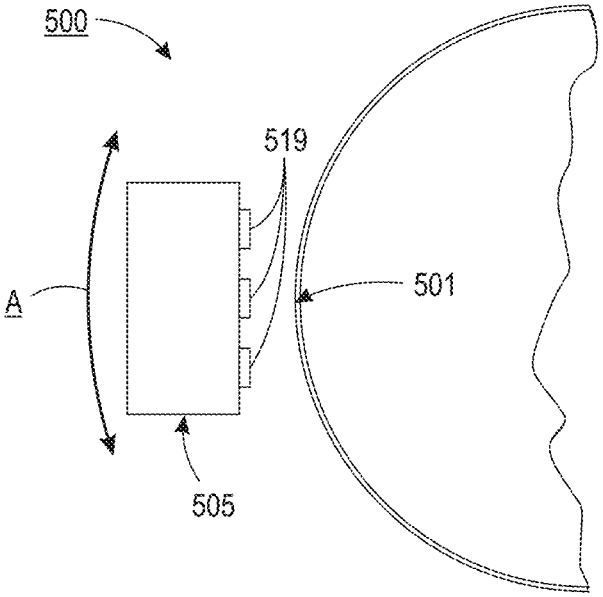
FIG. 5 shows a side diagrammatical view of an LED print head imaging system having a plurality of sensors disposed on an LED bar in accordance with an exemplary embodiment.

FIG. 5 shows an LED print bar apparatus and system having a plurality of sensors disposed on the bar. In particular, FIG. 5 shows an LED print bar apparatus and system 500. The system 500 includes a photoreceptor 501. The photoreceptor 501 includes a conductive surface.

The system 500 includes an LED bar 505. The LED bar 505 may include a plurality of sensors 519. The bar 505 may include three sensors 519 as shown in FIG. 5. A bar 505 having more than one sensor, including two or three sensors, for example, may be useful for determining any angular rotation of the photoreceptor 501. Such a system may be particularly useful for configurations wherein the optical and photoreceptor axis are not in line.

Systems in accordance with embodiments may also include sensors for detecting and measuring a humidity and a temperature that affects plate separation measurements. In particular, LED bar positions may be determined based on capacitance measurements as discussed above. The capacitance measurements may be adjusted or corrected for humidity and temperature using now known or later developed methods and sensing devices.

It will be appreciated that the above-disclosed and other features and functions, or alternatives thereof, may be desirably combined into many other different systems, methods, or applications. Also, various presently unforeseen or unanticipated alternatives, modifications, variations or improvements therein may be subsequently made by those skilled in the art.

What is claimed is:

1. A print head apparatus for use with a xerographic printing device having a photoreceptor belt, the photoreceptor belt being an endless belt wrapped around a first roller having a first axis and a second roller having a second axis, the first axis and the second axis being substantially parallel, the apparatus comprising:

an LED bar print head;

a first distance sensor located on the LED bar print head at a first location; and a second distance sensor located on the LED bar print head at a second location, wherein the LED bar print head is configured such that when the LED bar print head is positioned parallel to a portion of the photoreceptor belt that is located between the first roller and the second roller, the first distance sensor is positioned proximate the first roller, the second distance sensor is positioned proximate the second roller, and a distance between the first distance sensor and the second distance sensor is substantially equal to a distance between the first axis and the second axis, the first distance sensor is configured for measuring a first gap between the LED bar print head and the photoreceptor belt at the first location, and the second distance sensor is configured for measuring a second gap between the LED bar print head and the photoreceptor belt at the second location.

2. The apparatus of claim 1, wherein the LED bar print head has an optical center, the first and second distance sensors being disposed at each end of the optical center.

3. The apparatus of claim 1, wherein the first gap is measured by determining a first capacitance using the first distance sensor and the conductive surface of the photoreceptor belt, and the second gap is measured by determining a second capacitance using the second distance sensor and the conductive surface of the photoreceptor belt.

4. The apparatus of claim 3, wherein the first capacitance is corrected based on a detected humidity or a detected temperature, the detected humidity being detected by a humidity sensor, and the detected temperature being detected by a temperature sensor.

5. The apparatus of claim 1, further comprising a piezo actuating system to produce fine adjustments to the first gap and the second gap by moving the LED bar print head towards or away from the photoreceptor belt, the piezo actuating system including a piezo driver and at least one piezo stack, wherein the at least one piezo stack enables bidirectional motion of the LED bar print head as the at least one piezo stack expands and contracts under a changing applied actuation signal, the signal being based on a determined position of the LED bar print head, the position of the LED bar print head being determined based on the first capacitance and the second capacitance.

6. The apparatus of claim 5, wherein the piezo actuating system uses an active feedback loop to determine the amount of adjustment required based on a sensed position of the LED bar print head.

7. The apparatus of claim 6, wherein the active feedback loop is based on the first gap and the second gap.

8. The apparatus of claim 5, wherein the fine adjustments of the first gap and the second gap are based on determining if an image is out-of-focus based on optical analyses of the image on the photoreceptor belt or from printing a test sheet.

9. A print head system for use with a xerographic printing device, the system comprising:

a photoreceptor belt, the photoreceptor belt being an endless belt wrapped around a first roller having a first axis and a second roller having a second axis, the first axis and the second axis being substantially parallel, the photoreceptor belt having a conductive surface;

an LED bar print head, the LED bar print head being disposed a distance from the photoreceptor belt;

a first distance sensor, the first distance sensor being disposed on the LED bar print head at a first location; and a second distance sensor located on the LED bar print head at a second location, wherein the LED bar print head is positioned parallel to a portion of the photoreceptor belt that is located between the first roller and the second roller, the first distance sensor is positioned proximate the first roller, the second distance sensor is positioned proximate the second roller, and a distance between the first distance sensor and the second distance sensor is substantially equal to a distance between the first axis and the second axis, the first distance sensor measures a first gap between the LED bar print head and the photoreceptor belt at the first location, and the second distance sensor measures a second gap between the LED bar print head and the photoreceptor belt at the second location.

10. The system of claim 9, wherein the first gap is measured by determining a first capacitance using the first distance sensor and the conductive surface of the photoreceptor belt, and the second gap is measured by determining a second capacitance using the second distance sensor and the conductive surface of the photoreceptor belt.

11. The system of claim 10, wherein the first capacitance is corrected based on a detected humidity or a detected temperature, the detected humidity being detected by a humidity sensor, and the detected temperature being detected by a temperature sensor.

12. The system of claim 10, further comprising a piezo actuating system to produce fine adjustments to the first gap and the second gap by moving the LED bar print head towards or away from the photoreceptor belt, the piezo actuating system including a piezo driver and at least one piezo stack, wherein the at least one piezo stack enables bidirectional motion of the LED bar print head as the at least one piezo stack expands and contracts under a changing applied actuation signal, the signal being based on a determined position of the LED bar print head, the position of the LED bar print head being determined based on the first capacitance and the second capacitance.

13. The system of claim 12, wherein the piezo actuating system uses an active feedback loop to determine the amount of adjustment required based on a sensed position of the LED bar print head.

14. The system of claim 13, wherein the active feedback loop is based on the first gap and the second gap.

15. The system of claim 12, wherein the fine adjustments of the first gap and the second gap are based on determining if an image is out-of-focus based on optical analyses of the image on the photoreceptor belt or from printing a test sheet.

16. The system of claim 12, wherein the first capacitance is corrected based on a detected humidity or a detected temperature, the detected humidity being detected by a humidity sensor, and the detected temperature being detected by a temperature sensor.

* * * * *